US005508151A

United States Patent [19]

O'Toole et al.

[11] Patent Number: 5,508,151

[45] Date of Patent: Apr. 16, 1996

[54] PROCESSING OF PHOTOGRAPHIC ELEMENTS USING COPPER LIGAND COMPLEXES TO CATALYZE PERACID BLEACHING AGENTS

[75] Inventors: Terrence R. O'Toole, Webster, N.Y.; Mark F. Sistare, Carrboro, N.C.; Eric R. Schmittou, Rochester, N.Y.

[73] Assignee: Eastman Kodak Company, Rochester, N.Y.

[21] Appl. No.: 363,106

[22] Filed: Dec. 22, 1994

[51] Int. Cl.[6] ..... G03C 7/00; G03C 7/18; G03C 7/26; G03C 7/44

[52] U.S. Cl. ..... 430/393; 430/421; 430/427; 430/430; 430/461; 430/943; 252/186.1; 252/186.21; 252/186.39; 556/115; 556/116

[58] Field of Search ..... 430/461, 430, 430/393, 943, 421, 427; 252/186.21, 186.39, 186.1; 556/115, 116

[56] References Cited

U.S. PATENT DOCUMENTS

| | | | |
|---|---|---|---|
| 2,662,014 | 12/1954 | Umberger | 430/461 |
| 3,615,508 | 10/1971 | Stephen et al. | 96/60 |
| 3,660,092 | 5/1972 | Frank et al. | 96/54 |
| 3,859,092 | 1/1975 | Gysling et al. | 204/15 |
| 3,980,654 | 9/1976 | Gysling | 260/270 |
| 4,208,212 | 6/1980 | Kuzuwata et al. | 106/2 |
| 4,328,306 | 5/1982 | Idora et al. | 430/943 |
| 5,380,626 | 1/1995 | Nakamura et al. | 430/461 |

FOREIGN PATENT DOCUMENTS

| | | | |
|---|---|---|---|
| 2718988 | 11/1977 | Germany | 430/461 |
| 132552 | 10/1978 | Germany | 430/421 |
| 49102401 | 2/1973 | Japan . | |
| 53-36233 | 4/1978 | Japan | 430/461 |
| 53-141623 | 12/1978 | Japan | 430/430 |
| 54-1026 | 1/1979 | Japan | 430/393 |
| 62-151851 | 7/1987 | Japan | 430/461 |
| 62-226150 | 10/1987 | Japan | 430/430 |
| 201917 | 11/1967 | U.S.S.R. | 430/461 |
| 1442470 | 7/1976 | United Kingdom | 430/393 |
| 2042201 | 9/1980 | United Kingdom | 430/461 |

OTHER PUBLICATIONS

C. R. Dupree, "A Bleach System for Color Positive and Negative Film That Reduces Waste Treatment Requirements", *SMPTE Journal,* Feb. 1978, vol. 87, No. 2, pp. 84–88.

Research Disclosure 15170, Nov. 1976, pp. 97–98.

Research Disclosure, 15704, May 1977, p. 8.

*Primary Examiner*—Charles L. Bowers, Jr.

*Assistant Examiner*—J. Pasterczyk

*Attorney, Agent, or Firm*—J. Lanny Tucker

[57] ABSTRACT

Copper (II) ligand complexes are useful to catalyze the activity of peracid bleaching agents. The complexes can be included in the bleaching solutions, or used in a suitable solution prior to the bleaching step. The ligands are α-diimines having sites available to complex with copper (II).

16 Claims, 3 Drawing Sheets

PROCESSING OF PHOTOGRAPHIC ELEMENTS USING COPPER LIGAND COMPLEXES TO CATALYZE PERACID BLEACHING AGENTS

FIELD OF THE INVENTION

The present invention relates generally to the processing of photographic elements. More particularly, it relates to the use of certain copper catalysts in photographic peracid bleaching solutions or in solutions used prior to bleaching. The compositions and the methods for their use in photography are the subject of this invention.

BACKGROUND OF THE INVENTION

During processing of silver halide photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions which are more compatible with the environment, and thus it is desirable to reduce or avoid the use of ferric ions and many of the common complexing ligands.

Peracid bleaching solutions, such as those containing peroxide, persulfate, perborate, perphosphate, perhalogen, percarboxylic acid or percarbonate bleaching agents, offer an alternative to the ferric complex bleaching solutions. They are less expensive and present lower chemical and biological demands on the environment since their by-products can be less harmful.

However, there are certain problems associated with peroxide bleaching solutions. For example, acidic peroxide bleaching solutions are described in US-A-4,277,556 (Koboshi et al) which may contain metal ions as catalysts to improve the bleaching efficiency of the peroxide. Some of these solutions are stable, but they are not rehalogenating or silver retentive (that is, the developed silver can be oxidized to a soluble salt, and undeveloped silver halide remains in the element). This complicates silver recovery. Other peroxide bleaching solutions are known which contain a ferric ion complex as a catalyst. Such solutions are rehalogenating, but lack stability as iron is a well known catalyst for peroxide decomposition.

Thiols have been described as peroxide bleaching catalysts in some literature (JP-A-61/261739), but no demonstration of their effect was provided. Nonetheless, thiols are undesirable as catalysts because of their objectionable odors.

EPA-0 428 101 describes alkaline peroxide bleaching solutions which are rehalogenating, but such solutions lack sufficient stability and are described as bleaching photographic elements containing silver chloride emulsions only.

Other concerns with peroxide bleaching solutions include the potential for blistering in the element caused by the breakdown of peroxide into water and oxygen. This problem is referred to as vesiculation.

Other than vesiculation, there are similar problems associated with persulfate bleaching solutions. A rehalogenating persulfate bleaching solution needs a catalyst of some type, and the most commonly used catalyst is a thiol. As noted above, however, thiols are undesirable because of their odors.

There remains a need, therefore, for highly efficient peracid bleaching solutions which do not suffer from the problems noted above, that is, they are rehalogenating, stable, and useful for a variety of photographic elements, and lack objectionable odors.

SUMMARY OF THE INVENTION

The noted problems are solved with a method for processing a photographic element comprising:

treating an imagewise exposed and developed photographic element with a solution comprising a complex of copper(II) ion and an α-diimine ligand, the copper(II) ion being present in an amount of at least about 0.0002 mol/l, and the solution having a molar ratio of copper(II) ion to the ligand of less than or equal to about 4:1.

This invention also provides a method for processing a photographic element comprising:

treating an imagewise exposed and developed photographic element with a solution comprising a complex of copper(II) ion and an α-diimine ligand, the copper(II) ion being present in an amount of at least about 0.0002 mol/l, and the solution having a molar ratio of copper(II) ion to the ligand of less than or equal to about 4:1, and bleaching the element with a peracid bleaching solution comprising a peracid bleaching agent.

Further, this invention provides a bleaching solution comprising:

a peracid bleaching agent, a complex of a copper(II) ion and an α-diimine ligand, the copper(II) ion being present in an amount of at least about 0.0002 mol/l, and the bleaching solution having a molar ratio of copper(II) ion to the ligand of less than or equal to 4:1, and a rehalogenating agent.

The method of this invention provides rapid and efficient bleaching of the imagewise exposed and developed photographic elements and avoids the problems noted above with known methods. The specific copper(II) complexes described herein effectively catalyze the peracid bleaching action. In addition, the bleaching solution is preferably rehalogenating and useful with various silver halide emulsions. It is also an advantage that the copper(II) complexes adsorb to the processed photographic elements and can therefore be used effectively in a treatment carried out prior to the bleaching step, thereby improving the stability of the peracid bleaching agent.

These advantages are possible with the use of the particular complexes of copper(II) and α-diimines which are described in more detail below. The amount of copper(II) ion present must be at least about 0.0002 mol/l, and the molar ratio of copper(II) to the α-diimine ligand is less than or equal to about 4:1.

DETAILED DESCRIPTION OF THE INVENTION

Figure 1:
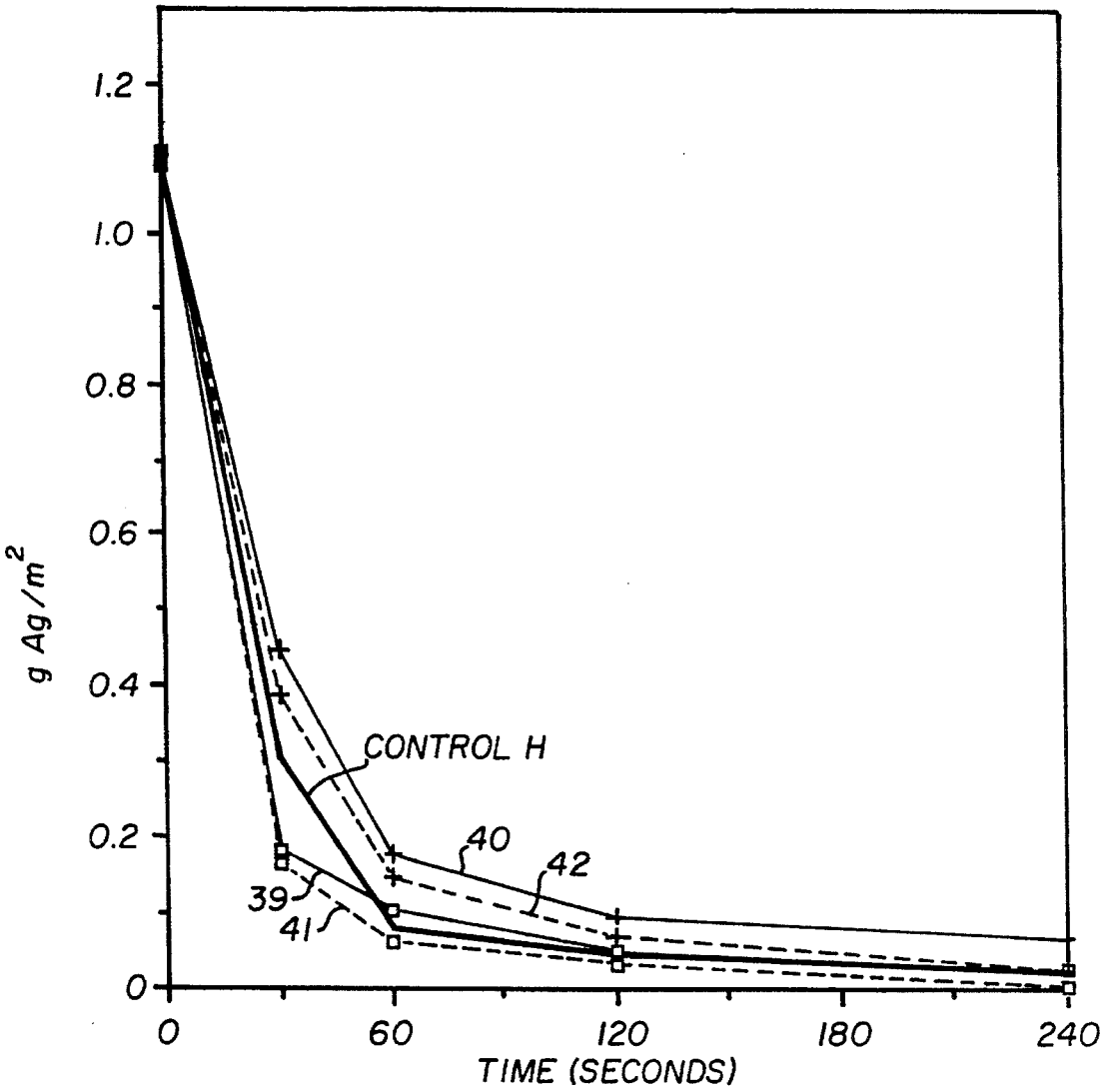
FIG. 1 is a graphical plot of residual silver metal versus time of bleaching for Examples 39–42 and Control H below.

The metal complexes useful as catalysts for peracid bleaching agents in this invention are complexes of copper(II) and certain α-diimine ligands.

In general, the α-diimine ligands useful in the practice of this invention are bi- or tridentate ligands containing at least two $sp^2$-hybridized nitrogen donor atoms incorporated in an unsaturated conjugated molecule. Particularly useful ligands include unsaturated bi- or tridentate ligands containing nitrogen donor atoms wherein one or two ligand molecules complex with a single copper(II) atom. Preferably, the nitrogen donor atoms of the ligand are attached to two different carbon atoms and separated from each other by those atoms.

The complexes useful herein can be generally represented by the formula $[CuLn]^a mX^Y$ wherein L represents the α-diimine ligand, "n" is the number of ligands coordinated to the copper(II) ion (generally 1 to 3, and preferably 1 or 2), "a" is the charge of the complex, X is a counterion for the complex, "y" is the charge of the counterion, and "m" is the absolute value of the ratio of "a" to "y".

In the present invention, cationic complexes (complexes with a net positive charge) are preferred. In such complexes, X can be halide (such as chloride, bromide or iodide), sulfate, sulfite, carbonate, nitrate, bicarbonate, hydrogenphosphate, dihydrogenphosphate, nitrite, phosphate, phosphite or an organic anion such as a carboxylate, sulfonate, phosphonate or another counterion which would be readily apparent to one skilled in the art.

Alternatively, the complex can be anionic (having a net negative charge). In such complexes, X is generally an inorganic cation such as an alkali or alkaline earth metal ion (such as sodium, potassium calcium, lithium or magnesium), a first row transition metal ion (such as zinc, nickel, manganese, cobalt or iron), ammonium ion, or another organic cation such as quaternary ammonium cations or protonated amines, and other cations which would be readily apparent to one skilled in the art which would not interfere with copper(II) complex formation with the ligand.

It is also possible for the copper(II) complex to be neutral in charge, in which case, "a" is 0.

A more particular definition of an α-diimine ligand L is provided in the following structure (I):

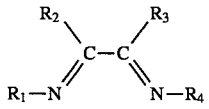

wherein $R_1$, $R_2$, $R_3$ and $R_4$ are independently hydrogen, a substituted or unsubstituted alkyl group having 1 to 12 carbon atoms (such as methyl, ethyl, propyl, isopropyl, n-butyl, t-butyl, hexyl, benzyl, decyl, dodecyl and 4-aminohexyl), a substituted or unsubstituted aryl group having 6 to 14 carbon atoms in the ring structure (such as phenyl, tolyl, xylyl, naphthyl, phenanthryl, biphenyl and anthryl), a substituted or unsubstituted cycloalkyl group of 5 to 14 carbon atoms in the ring structure (such as cyclopentyl, cyclohexyl, 3,4-dimethylcyclohexyl, bicyclohexyl and decahydronaphthyl), or a substituted or unsubstituted heterocycle having 5 to 14 carbon, nitrogen, sulfur or oxygen atoms in the ring structure. Representative heterocyclic ring structures are described below. By "ring structure" we contemplate moieties having one or more (fused) rings in the same molecule. Any of these groups can be substituted with one or more ether, ester, hydroxy, amine, amide, alkoxy (as defined below), aryloxy (as defined below), keto (or oxo), carboxylate, halo (such as chloro, bromo or iodo), nitro, cyano, pyridyl, sulfonate, phosphonate, thiol, thioether or sulfonamide groups.

In addition, $R_1$, $R_2$, $R_3$ and $R_4$ can be independently —OR' or —NR'R" wherein R' and R" are independently hydrogen or any of the groups described above in the preceding paragraph, any of which can be substituted also as described in the preceding paragraph.

Alternatively, $R_1$ and $R_2$ together, or $R_3$ and $R_4$ together, independently represent the nitrogen, oxygen, sulfur and carbon atoms necessary to form a 5- to 14-membered N-containing heterocyclic ring structure ("ring structure" defined above), $R_2$ and $R_3$ together represent the carbon atoms necessary to form a 5- to 14-membered carbocyclic ring structure ("ring structure" defined above), or $R_2$ and $R_3$ together represent the nitrogen, oxygen, sulfur and carbon atoms necessary to form a 5- to 14-membered heterocyclic ring structure. In such ring structures, any of $R_1$, $R_2$, $R_3$ and $R_4$ can include heteroatoms directly bonded to the nitrogen and carbon atoms of the alpha-diimine molecular backbone.

Also contemplated in the definitions of ring structures above are the embodiments wherein two or more of the ring structures defined above for $R_1$ and $R_2$ together, $R_2$ and $R_3$ together, and $R_3$ and $R_4$ together, are fused together.

Some of the possible heterocyclic rings structures include, but are not limited to, pyridyl, pyrazinyl, pyrimidinyl, pyridazinyl, thiazolyl, thiadiazolyl, thiatriazolyl, isoindolyl, benzoxazolyl, benzthiazolyl, benzimidazolyl, indazolyl, isopyrrolyl, pyrazolyl, imidazolyl, triazolyl, oxazolyl, isoxazolyl, oxadiazolyl, oxatriazolyl, dioxazolyl, triazinyl, oxazinyl, oxathiazinyl, diazepinyl, indolyl, isoindazolyl, quinolyl, isoquinolyl, indoxazinyl, quinazolinyl, pyridopyridyl, cinnolinyl, benzoxazinyl, pteridinyl, quinoxalinyl and furazanyl.

In addition to the ring structures defined in the preceding paragraph, $R_2$ and $R_3$ together can also form a quinolinyl, pyrrolyl, furanyl, thiophenyl or pyranyl group. Carbocyclic groups which can be similarly formed include, but are not limited to, cyclohexyl, phenyl, naphthyl, anthryl, xylyl, phenanthryl and decahydronaphthyl.

Any of these heterocyclic or carbocyclic groups can also be substituted with one or more ether, ester, hydroxy, alkoxy, aryloxy, keto (oxo), carboxylate, halo, nitro, cyano, amine, amide, pyridyl, sulfonate, phosphonate, thiol, thioether or sulfonamide groups as defined above.

In reference to structure (I), it is preferred that each of $R_1$ and $R_2$ together, and each of $R_3$ and $R_4$ together, represent the atoms necessary to form the same 5- to 14-membered substituted or unsubstituted N-containing heterocyclic ring structure, as described above. Most preferably, that ring is a substituted or unsubstituted pyridine (could be part of a fused ring structure such as phenanthroline), pyrimidine, pyrazine, or pyridazine ring.

Representative bidentate α-diimine ligands which can be used in the practice of this invention include, but are not limited to, substituted or unsubstituted 2,2'-bipyridine, substituted or unsubstituted 1,10-phenanthroline, substituted or unsubstituted 4,7-diphenyl-1,10-phenanthroline, substituted or unsubstituted 2,2'-biquinoline, substituted or unsubstituted 5-phenyl-1,10-phenanthroline, substituted or unsubstituted 4,7-diphenyl-1,10-phenanthrolinesulfonic acid, substituted or unsubstituted 2,2'-bipyrimidine, substituted or unsubstituted 2,2'-bipyrazine, substituted or unsubstituted 3,3'-bipyridazine, and substituted or unsubstituted 1,2-phenylenediimine.

The substituted or unsubstituted 2,2'-bipyridine compounds, substituted or unsubstituted 2,2-bipyrimidine, substituted or unsubstituted 2,2'-bipyrazine, substituted or unsubstituted 3,3'-bipyridazine, and substituted or unsubstituted 1,10-phenanthroline compounds are most preferred. The possible substituents are those described above for the more generic groups.

Representative tridentate α-diimine ligands include, but are not limited to, substituted or unsubstituted 2,2': 6',2"-terpyridine.

Other bi- and tridentate ligands are described by McWhinnie et al, *Advan. Inorg. Radiochem.*, 12, 135 (1969).

In the foregoing formula, L can be a mixture of ligands.

Particular α-diimine ligands useful herein include:

2,2'-bipyridine (Compound 1),
4,4'-dimethyl-2,2'-bipyridine (Compound 2),
2,2'-bipyrimidine (Compound 3),
2,2'-bipyrazine (Compound 4),
3,3'-bipyridazine (Compound 5),
1,10-phenanthroline (Compound 6),
5-chloro-1,10-phenanthroline (Compound 7),
5-nitro-1,10-phenanthroline (Compound 8),
5-methyl-1,10-phenanthroline (Compound 9),
1,10-phenanthroline-5,6-dione (Compound 10),
4-methyl-1,10-phenanthroline (Compound 11),
2-(2-pyridyl)-4-chloroquinazoline (Compound 12),
2,2':6'2"-terpyridine (Compound 13),
4'-ethoxy-2,2':6',2"-terpyridine (Compound 14),
2-(2-pyridyl)-benzimidazole (Compound 15),
4,5-dimethyl-1,2-phenylenediimine (Compound 16) ,
2,3-bis(2-pyridyl)-5,6-dihydropyrazine (Compound 17), and
2,3-bis(2-pyridyl)pyrazine (Compound 18).

In the most general sense, the amount of copper(II) ion present in the solution is at least about 0.0002 mol/l. From about 0.0002 to about 0.05 mol/l is preferred, and from about 0.001 to about 0.01 mol/l being more preferred. At least some of the copper(II) ion is present in the solution in complexed form, but some copper(II) ions can be present in free form.

The amount of α-diimine ligand is then determinable from the mol ratio of metal ion to diimine ligand. A ratio of less than or equal to 4:1, copper(II) to diimine ligand is generally useful. Preferred ratios are from about 2:1 to about 1:5, and more preferred ratios are from about 1:1 to about 1:3.

The solution containing the copper(II) complex can have a pH of from about 1 to about 7. When the solution is a bleaching solution, the preferred pH is from about 3 to about 5, whereas if the solution is used as a prebath solution, the pH may be from about 1 to about 7, but preferably, it is from about 3 to about 7. Various buffers may be present to maintain a desired pH in amounts which would be readily apparent to one skilled in the art. Such materials include, but are not limited to, organic or inorganic monobasic, dibasic and tribasic acids or protonated amines having at least one pKa between 1 and 9. Specifically useful buffers include acetate, 2-methylacetate, maleate, glycolate, succinate, imidazole, 3-morpholino-2-hydroxypropane sulfonate, 4-sulfophthalate, trimellitate, bisulfate and dihydrogen phosphate. Mixtures of buffers can also be used. Buffer counterions may include sodium, potassium, ammonium and tetraalkylammonium ions among others readily apparent to one skilled in the art. The amount of buffer used is generally from about 0.01 to about 2 mol/l, with from about 0.05 to about 1 mol/l being preferred.

The complexes useful herein can be prepared in an aqueous solution by mixing a source of copper(II) ion, which is generally a suitable salt, with a source of the diimine ligand which is generally a neutral solid or acid salt. Useful copper(II) salts include, but are not limited to, copper(II) sulfate, copper(II) chloride, copper(II) perchlorate, copper(II) nitrate, copper(II) bromide and copper(II) acetate. Copper(II) sulfate and copper(II) chloride are preferred. The α-diimine ligand can be supplied in a water-miscible organic solvent such as ethanol (or other lower alcohols), acetonitrile, tetrahydrofuran, dimethylsulfoxide, or N,N-dimethylformamide, or in water. The complex can be precipitated by addition of a solvent such as tetrahydrofuran, filtered and dried. Alternatively, the isolated complex can be provided in an aqueous solution as a prebath solution described herein.

The α-diimine ligands useful in making the complexes can be obtained from several commercial sources, including Aldrich Chemical Company, or they can be prepared using conventional starting materials and procedures.

The copper(II) complexes described herein can be used in a variety of arrangements in the processing of photographic elements. For example, they can be included in the bleaching solutions. Alternatively and preferably, they are used in a processing solution (such as a "prebath", or developer "stop" solution) prior to bleaching. Still again, they can be used after bleaching when the bleaching solution is carried over into the next bath.

As noted above, the copper(II) complexes can be used in peracid bleaching solutions. Such solutions contain the conventional peracid bleaching agents, including, but not limited to, hydrogen, alkali and alkaline earth salts of persulfate, peroxide, percarboxylic acid, perphosphate and percarbonate, and the related perhalogen bleaching agents such as hydrogen, alkali and alkaline earth salts of chlorate, bromate, iodate, perchlorate and metaperiodate. Examples of such bleaching solutions are well known and described, for example, in *Research Disclosure,* publication 36544, pages 501–541 (September, 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Especially preferred peracid bleaching solutions are the persulfate and peroxide bleaching solutions. Peroxide bleaching solutions are more preferred, such as solutions containing hydrogen peroxide or a compound which releases or generates hydrogen peroxide.

The amounts of peracid bleaching agents used in such solutions are well known in the art. For example, in persulfate solutions, the amount of persulfate ion is generally from about 0.02 to about 2 mol/l. In peroxide solutions, the amount of peroxide is generally from about 0.1 to about 2 mol/l.

In a preferred embodiment of this invention, the bleaching solution also comprises one or more rehalogenating agents, such as chloride or bromide. The rehalogenating agent is generally present in an amount of from about 0.02 to about 2 mol/l with from about 0.05 to about 1.0 mol/l being more preferred. Any acceptable counterion can be used with the rehalogenating agent. Ammonium is preferred for water solubility, but potassium or sodium may also be desirable for environmental reasons.

The bleaching solution can also be what is known in the art as a silver-retentive bleaching solution which comprises an agent for generating a water-insoluble silver salt other than silver halide, as described for example in US-A-4,454,224 (Brien et al).

Other addenda commonly added to bleaching solutions can also be included, such as corrosion inhibitors, optical whitening agents, defoaming agents, calcium chelating agents, halogen scavengers, peroxide stabilizers, radical scavengers, and other materials readily apparent to one skilled in the art.

In a preferred embodiment of this invention, the copper(II) diimine complex is used as a separate "prebath" solution prior to the bleaching step. Such prebath solutions contain the complex in amounts as described above and have the noted pH, with or without buffers. Weak or strong acids may be present to adjust the pH. Other addenda useful in such prebath solutions would be readily apparent to one skilled in the art. including those addenda optionally used in bleaching solutions, noted above.

In still another embodiment, the copper(II) diimine complex can be included in what are known as developer "stop" solutions having a pH preferably of from about 1 to about 5. One or more suitable buffers are included at a concentration of from about 0.05 to about 4 mol/l (preferably from about 0.1 to about 2 mol/l).

When the prebath or developer stop solution contains the copper(II) diimine complex, the bleaching solution generally does not. However, in one embodiment, both the prebath and bleaching solutions contain the same or different copper(II) diimine complexes. Thus, a first complex can be used in the prebath, and a second complex can be used in the bleaching solution.

There can optionally be an intermediate wash step between the use of a prebath or developer stop solution containing the complex and bleaching. The wash solution can be merely water, or a suitable acidic rinse comprising one or more weak or strong acids which would be readily apparent to one skilled in the art.

In yet another embodiment, a fixing step can precede use of the copper(II) diimine complex.

The operating temperature for using the prebath or bleaching solution containing the copper(II) diimine complex is generally from about 10° to about 50° C., and preferably from about 25° to about 40° C.

As used herein in defining amounts of materials, the term "about" refers to ±20% of the indicated value. In defining pH, it refers to ±0.5 pH unit, and in defining temperature, it refers to ±5° C.

One preferred bleaching solution of this invention comprises:

a peracid bleaching agent, a complex of copper(II) and an α-diimine ligand as described above, a rehalogenating agent, and optionally, one or more compounds selected from the group consisting of:

a defoaming agent, a halogen scavenger, a secondary bleaching accelerator, that is, one other than the copper(II) α-diimine complex described herein, a calcium chelating agent, a corrosion inhibitor, and an optical whitening agent.

Conventional fixing solutions can be used at an appropriate time in the processing of the elements. Such solutions contain fixing agents, such as thiosulfates, thioethers, thiocyanates, amines, mercapto-containing compounds, thioamides, thioureas, iodides, and others which would be readily apparent to one skilled in the art. Particularly useful fixing agents include, but are not limited to, ammonium thiosulfate, sodium thiosulfate, potassium thiosulfate, guanidine thiosulfate, and various thioethers. Useful and optimum amounts of fixing agents would be readily apparent to one skilled in the art, and are generally from about 0.1 to about 3 mol/l.

The fixing solution can also contain a preservative such as a sulfite (such as ammonium sulfite), a bisulfite or a metabisulfite, or a fixing accelerator.

If desired, the copper(II) diimine complexes described herein can be recovered for reuse with conventional ion exchange resins and procedures after their use in processing photographic elements. Sulfonated polystyrene resins constitute one useful class of ion exchange materials.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure,* noted above. All types of emulsions can be used in the elements, including but not limited to, thin tabular grain emulsions, and either positive-working or negative-working emulsions. The elements can be either photographic film or paper elements.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Development is then followed by the use of a solution containing a copper(II) diimine complex as described herein. The bleaching and fixing steps can be carried out in any suitable fashion, as is known in the art. Subsequent to bleaching and fixing, a final washing or stabilizing step may be employed. Color prints and films can be processed using a wide variety of processing protocols, as described for example, in *Research Disclosure,* noted above.

The following examples are presented to illustrate the practice of this invention, and are not intended to be limiting in any way. Unless otherwise indicated, all percentages are by weight.

EXAMPLES 1–5

Bleaching Compositions Containing Copper (II) α-Diimine Complexes

Several compositions of this invention were compared to several Control compositions outside the scope of this invention to evaluate the catalytic effect of the copper(II) diimine complexes described herein.

Samples of KODAK GOLD PLUS™ 100 photographic film were exposed 0.5 second with 5500K illumination and processed using the following protocol to yield 1.24 g/m$^2$ of developed silver metal:

| | |
|---|---|
| 3.25 minutes | Development* |
| 1 minute | Stop solution (1% v/v $H_2SO_4$) |
| 1 minute | Water wash |
| 4 minutes | Fixing** |
| 3 minutes | Water wash |
| 1 minute | KODAK PHOTO-FLO ™ rinse |
| 5 minutes | Dry. |

*The developing solution (per liter) was an aqueous solution of potassium carbonate (34.3 g), potassium hydrogen carbonate (2.3 g), sodium sulfite (3.7 g), potassium iodide (1.2 mg), sodium bromide (1.3 g), diethylenetriaminepentaacetic acid (40% w/w, 8.4 g), hydroxylamine sulfate (2.4 g) and KODAK ™ Color Developing Agent CD4 (4.5 g), and had a pH of 10.05.
*The fixing solution (per liter) was an aqueous solution of sodium metabisulfite (11.8 g) and a solution (162 ml) of ammonium thiosulfate (56.5%) and ammonium sulfite (4%), and had a pH of 6.5. KODAK PHOTO-FLO ™ is a commercially available rinse.

For Examples 1–38 and Controls A–K, the developed film samples were mounted in an optically transparent cell which was fitted within a conventional UV/visible spectrophotometer. As the bleaching solution was passed over the film sample, the loss in optical density was monitored at 820 nm and 25° C. The loss in optical density is directly related to the bleaching of silver metal to silver halide.

The Control A bleaching solution contained hydrogen peroxide (0.98 mol/l, 3% w/w), sodium bromide (0.15 mol/l) and sodium acetate (0.04 mol/l), and was adjusted to pH 3.7 with acetic acid (0.26 mol/l).

The Control B solution was like Control A with the addition of copper(II) sulfate, hydrate, (2 mmol/l).

The Control C solution was like Control A with the addition of copper(II) sulfate, hydrate (0.2 mmol/l).

The Control D solution was like Control A with the addition of Compound 1 (10 mmol/l).

The Control E solution was like Control B with the addition of tetrasodium ethylenediaminetetraacetate (10 mmol/l).

In Control F, prior to bleaching, the developed film sample was immersed in an aqueous solution of N-methylphenazinium methosulfate (5 mmol/l) co-catalyst for 1 minute and dried. Bleaching was carried out using the Control A solution.

In Control G, prior to bleaching, the developed film sample was immersed in an aqueous solution of N-methylphenazinium methosulfate (5 mmol/l) co-catalyst for 1 minute, washed in water for 1 minute, and dried. Bleaching was carried out using the Control B solution.

In Control H, the developed film sample was contacted with conventional FLEXICOLOR™ Bleach III solution which contains a complex of iron(III) and propylenediaminetetraacetic acid, and is used in conventional Process C-41.

The Example 1 solution was the Control A solution to which was added copper(II) sulfate, hydrate (2 mmol/l) and Compound 1 (10 mmol/l).

The Example 2 solution was the Control A solution to which was added copper(II) sulfate, hydrate (2 mmol/l) and Compound 1 (4 mmol/l).

The Example 3 solution was the Control A solution to which was added copper(II) sulfate, hydrate (0.2 mmol/l) and Compound 1 (1 mmol/l).

The Example 4 solution was the Control A solution to which was added copper(II) sulfate, hydrate (2 mmol/l) and Compound 6 (10 mmol/l).

In Example 5, prior to bleaching, the developed film was immersed in an aqueous solution of N-methylphenazinium methosulfate (5 mmol/l) co-catalyst for 1 minute, washed in water for 1 minute, and dried. Bleaching was carried out with the Example 3 solution.

The results of these bleaching treatments are listed in Table I below. The bleaching results are measured as "$t_{50}$" which represents the time (seconds) required for 50% of total possible bleaching to occur. It is apparent that all of the solutions of the present invention provided more effective bleaching than Controls A–F, and some are superior to the standard C-41 bleach (Control H). While the Control H bleach provided rapid bleaching, there is interest in the industry to find more environmentally compatible bleaching solutions, which is one advantage of the present invention. A comparison of Control G to Example 5 also illustrates the beneficial effects of the copper(II) α-diimine complex.

TABLE I

| Bleaching Solution | Prebath | Cu(II) Level (mmol/l) | α-Diimine Level (mmol/l) | $t_{50}$ (seconds) |
|---|---|---|---|---|
| Control A | Not used | 0 | 0 | ** |
| Control B | Not used | 2 | 0 | 165 |
| Control C | Not used | 0.2 | 0 | 187 |
| Control D | Not used | 0 | 10 | ** |
| Control E | Not used | 2 | 10# | ** |
| Control F | 5 mmol* | 0 | 0 | ** |
| Control G | 5 mmol* | 2 | 0 | 21 |
| Control H@ | Not used | Not used | Not used | 32 |
| Example 1 | Not Used | 2 | 10 | 29 |
| Example 2 | Not used | 2 | 4 | 29 |
| Example 3 | Not used | 0.2 | 1 | 64 |
| Example 4 | Not used | 2 | 10 | 105 |
| Example 5 | 5 mmol* | 2 | 10 | 15 |

*N-methylphenazinium methosulfate only.
**No bleaching took place, or was not complete within 500 seconds.
#Ethylenediaminetetraacetic acid, not an α-diimine.
@Not a peracid bleach, but contained a ferric(III) complex bleaching agent.

EXAMPLES 6–38

Use of Copper(II) α-Diimine Complexes in Prebath Solutions

These examples demonstrate the practice of the present invention using prebath solutions prior to peroxide bleaching. The experiments were carried out using the flow cell apparatus and developed photographic film described in previous examples.

In all experiments, the prebath treatment was carried out for 1 minute, followed by a water rinse prior to bleaching with the Control A solution.

In Control I, the prebath used was an aqueous solution of copper sulfate, hydrate (2 mmol/l).

In Control J, the prebath used was an aqueous solution of copper chloride (2 mmol/l).

In Control K, the prebath contained only the α-diimine ligand, Compound 1 (10 mmol/l) and no copper(II) ion.

In Example 6, the prebath comprised an aqueous solution of copper sulfate, hydrate (2 mmol/l) and Compound 1 (10 mmol/l).

The materials and amounts used in all experiments are shown in Table II below. Table II also shows the bleaching results. The prebath solutions for Examples 37 and 38 also contained N-methylphenazinium methosulfate (5 mmol/l and 0.5 mmol/l, respectively) co-catalyst (or secondary peroxide bleaching accelerator).

TABLE II

| Experiment | Prebath Cu(II) (mmol/l) | Composition Cu(II) Salt | α-Diimine Ligand (mmol/l) | $t_{50}$ (seconds) |
|---|---|---|---|---|
| Control I | 2 | Sulfate | 0 | 95 |
| Control J | 2 | Chloride | 0 | ** |
| Control K | 0 | None | Compound 1(10) | ** |
| Example 6 | 2 | Sulfate | Compound 1(10) | 10 |
| Example 7 | 2 | Sulfate | Compound 1(4) | 10 |
| Example 8 | 2 | Sulfate | Compound 1(2) | 10 |
| Example 9 | 2 | Chloride | Compound 1(2) | 12 |
| Example 10 | 2 | Sulfate | Compound 6(10) | 38 |
| Example 11 | 2 | Sulfate | Compound 6(4) | 22 |
| Example 12 | 2 | Sulfate | Compound 6(2) | 19 |
| Example 13 | 0.2 | Sulfate | Compound 1(1) | 47 |
| Example 14 | 0.4 | Sulfate | Compound 1(2) | 27 |
| Example 15 | 1 | Sulfate | Compound 1(5) | 14 |
| Example 16 | 2 | Chloride | Compound 2(2) | 24 |
| Example 17 | 2 | Chloride | Compound 3(2) | 8 |
| Example 18 | 2 | Chloride | Compound 3(1) | 10 |
| Example 19 | 2 | Chloride | Compound 4(2) | 40 |
| Example 20 | 2 | Chloride | Compound 4(1) | 47 |
| Example 21 | 2 | Chloride | Compound 5(2) | 18 |
| Example 22 | 2 | Chloride | Compound 5(1) | 25 |
| Example 23 | 2 | Chloride | Compound 7(2) | 28 |
| Example 24 | 2 | Chloride | Compound 8(2) | 24 |
| Example 25 | 2 | Chloride | Compound 9(2) | 23 |
| Example 26 | 2 | Chloride | Compound 10(2) | 51 |
| Example 27 | 2 | Chloride | Compound 11(2) | 23 |
| Example 28 | 2 | Chloride | Compound 12(2) | 56 |
| Example 29 | 2 | Chloride | Compound 13(2) | 78 |
| Example 30 | 2 | Chloride | Compound 14(2) | 26 |
| Example 31 | 2 | Chloride | Compound 15(4) | 77 |
| Example 32 | 2 | Chloride | Compound 16(2) | 72 |
| Example 33 | 2 | Chloride | Compound 17(2) | 15 |
| Example 34 | 2 | Chloride | Compound 17(1) | 24 |
| Example 35 | 2 | Chloride | Compound 18(2) | 16 |
| Example 36 | 2 | Chloride | Compound 18(1) | 21 |
| Example 37* | 0.2 | Sulfate | Compound 1(1) | 8 |
| Example 38* | 0.2 | Sulfate | Compound 1(1) | 20 |

*Prebath also contained N-methylphenazinium methosulfate as an additional bleaching accelerator, 5 mmol/l in Example 37 and 0.5 mmol/l in Example 38.
**No bleaching occurred, or bleaching not complete after 500 seconds.

It is clear from the data obtained from these examples that the α-diimine ligands form complexes with the copper(II) ions which are more active as catalysts for the bleaching agent than the free copper(II) ion or α-diimine alone.

EXAMPLES 39–48

Use of Copper(II) α-Diimine Complexes in Photographic Processing Protocols

Figure 2:
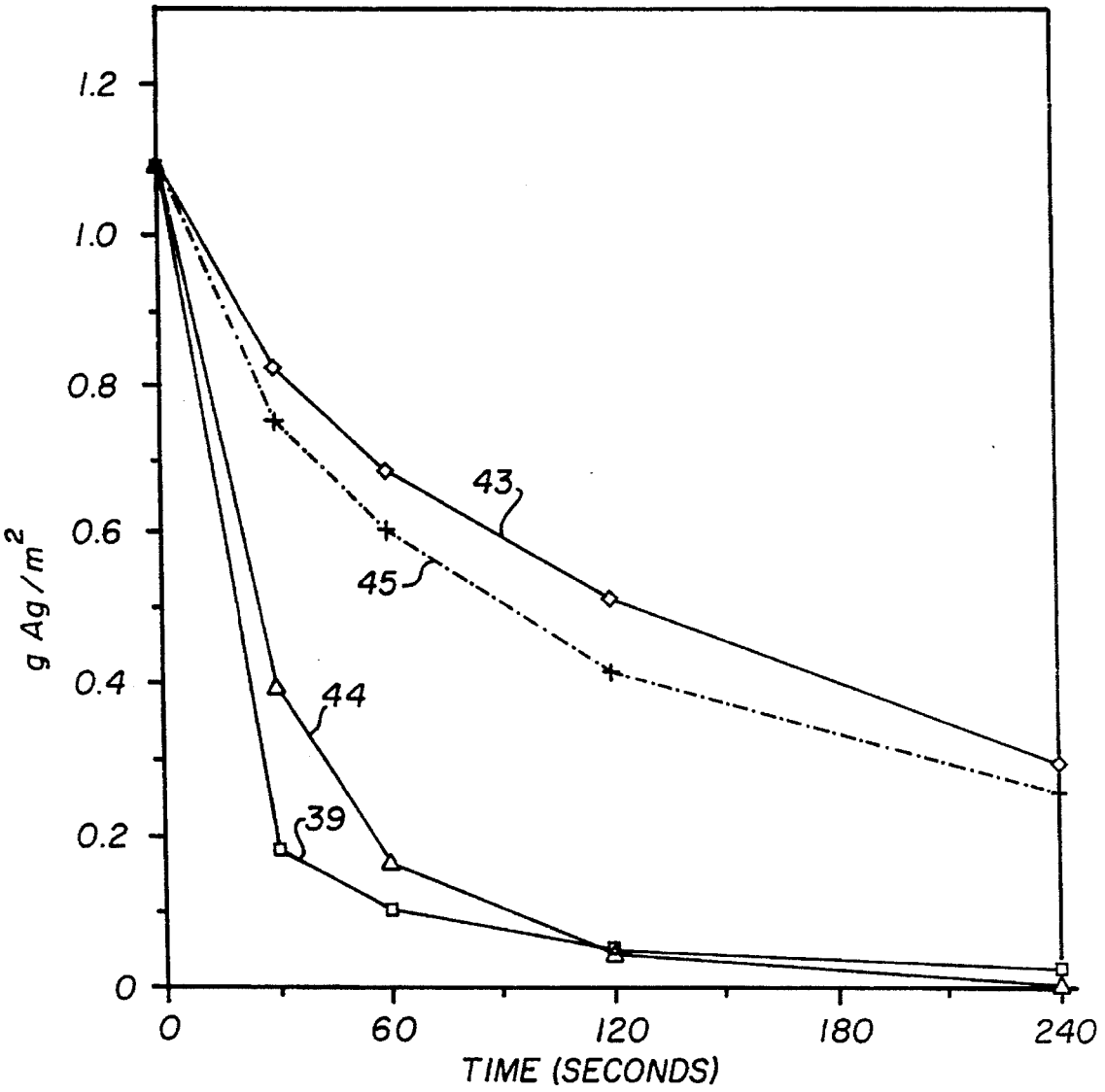
FIG. 2 is a graphical plot of residual silver metal versus time of bleaching for Examples 39 and 43–45 below.
Figure 3:
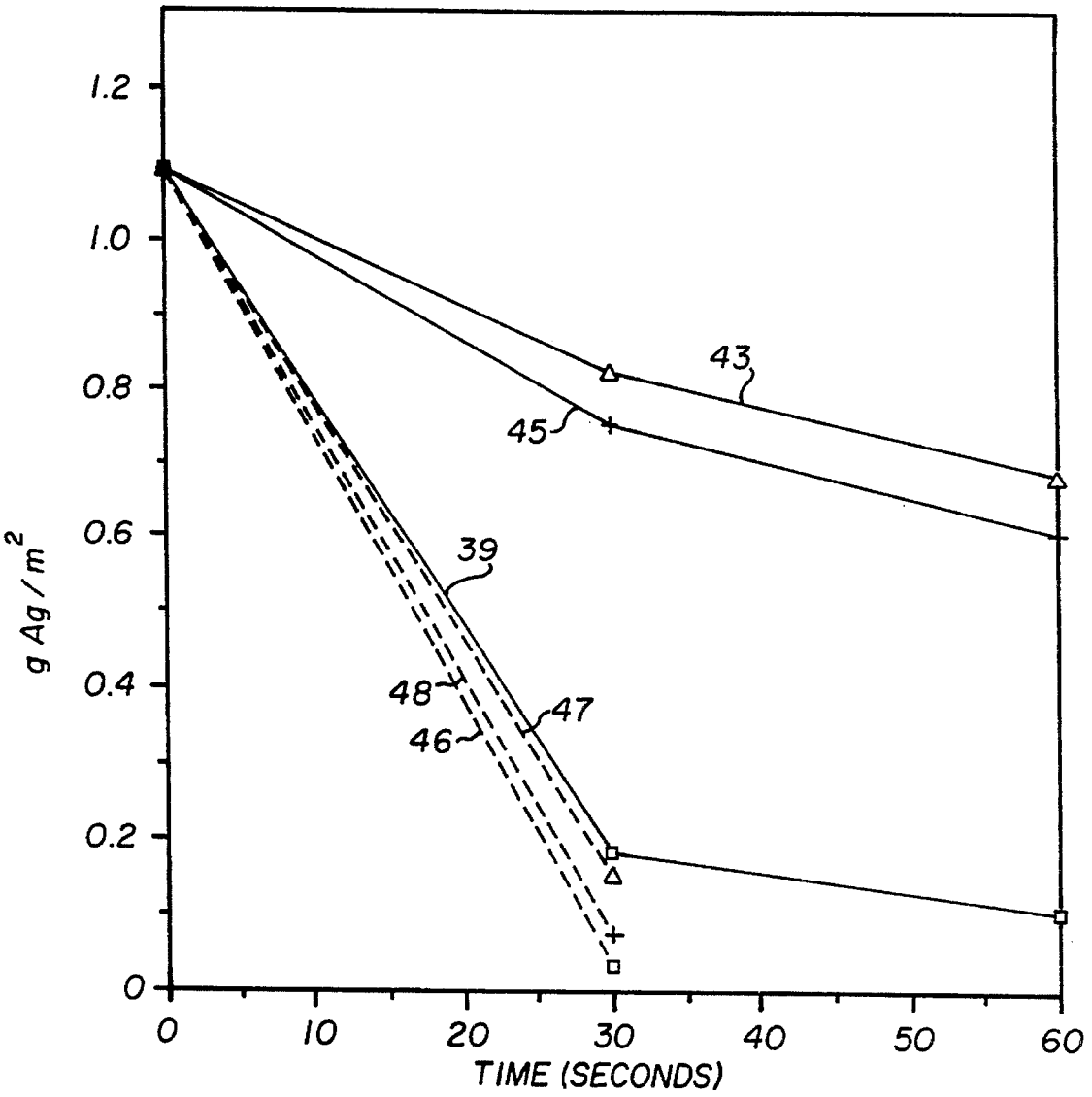
FIG. 3 is a graphical plot of residual silver metal versus time of bleaching for Examples 39, 43 and 45–48 below.

In these examples, the invention was practiced using prebath solutions containing a copper(II) α-diimine complex prior to bleaching of samples of KODAK GOLD PLUS™ 100 photographic film using three different processing protocols. The film samples were step exposed for 1/25 second using a 0–4 density, 21 step tablet with a 5500K illumination. Processing was performed at 37.9° C. using the protocols noted in Table III below. In addition, the $D_{max}$ residual silver values are shown in FIGS. 1–3. FIG. 3 indicates that a fixing step prior to the prebath step can further enhance the bleaching rate for silver iodobromide emulsion containing photographic films.

The prebath reagents and amounts, and bleaching agent amounts and results are listed in Table III below.

TABLE III

| Example | Processing Protocol (see below) | Copper Sulfate Level (mmol/l) | α-Diimine Ligand (mmol/l) | Peroxide Level[a] (mol/l) | Time for complete bleaching[b] (seconds) |
|---|---|---|---|---|---|
| 39 | I | 2 | Compound 1(10) | 0.98 | 120 |
| 40 | I | 2 | Compound 1(10) | 0.26 | 240 |
| 41 | II | 2 | Compound 1(10) | 0.98 | 60 |
| 42 | II | 2 | Compound 1(10) | 0.26 | 120 |
| 43 | I | 0.2 | Compound 1(1) | 0.98 | [e] |
| 44[c] | I | 0.2 | Compound 1(1) | 0.98 | 120 |
| 45[d] | I | 0.2 | Compound 1(1) | 0.98 | [e] |
| 46 | III | 2 | Compound 1(10) | 0.98 | 30 |
| 47 | III | 0.2 | Compound 1(1) | 0.98 | 60 |
| 48[d] | III | 0.2 | Compound 1(1) | 0.98 | 30 |

[a]The bleaching solution also contained sodium bromide (0.15 mol/1), acetic acid (0.3 mol/1) and was adjusted to pH 3.7 with sodium hydroxide.
[b]Bleaching was considered complete when the residual silver was less than 76 mg/m$^2$. The standard bleaching time for the conventional Process C-41 is 240 seconds.
[c]The bleaching solution also contained N-methylphenazinium methosulfate (5 mmol/l) as a secondary bleaching accelerator.
[d]The prebath solution also contained N-methylphenazinium methosulfate (5 mmol/l) as a secondary peroxide bleaching accelerator.
[e]Bleaching was incomplete after 240 seconds.

Processing Protocol I:

| | |
|---|---|
| 3 minutes, 15 seconds | Development* |
| 1 minute | Stop solution (1% v/v $H_2SO_4$) |
| 1 minute | Water wash |
| 1 minute | Prebath solution** |
| 1 minute | Water wash |
| Various times | Bleaching |
| 3 minutes | Water wash |
| 4 minutes | Fixing* |
| 3 minutes | Water wash |
| 1 minute | PHOTO-FLO ™ rinse |

*Same as in Examples 1–5.
**Containing the copper(II) diimine complex as shown in Table III Processing Protocol II:

| | |
|---|---|
| 3 minutes, 15 seconds | Development* |
| 1 minute | Stop solution** |
| 1 minute | Water wash |
| Various times | Bleaching |
| 3 minutes | Water wash |
| 4 minutes | Fixing* |
| 3 minutes | Water wash |
| 1 minute | PHOTO-FLO ™ rinse |

*Same as in Examples 1–5.
**Contains the copper(II) diimine complex as shown in Table III and 0.1 mol/l sodium sulfate, adjusted to pH 2.0 with sulfuric acid.

Processing Protocol III:

| | |
|---|---|
| 3 minutes, 15 seconds | Development* |
| 1 minute | Stop solution (1% v/v $H_2SO_4$) |
| 1 minute | Water wash |
| 4 minutes | Fixing* |
| 3 minutes | Water wash |
| 1 minute | Prebath solution** |
| 1 minute | Water wash |

TABLE III-continued

| | |
|---|---|
| Various times | Bleaching |
| 1 minute | Water wash |
| 4 minutes | Fixing* |
| 3 minutes | Water wash |
| 1 minute | PHOTO-FLO ™ rinse |

*Same as in Examples 1–5.
**Containing the copper(II) diimine complex as shown in Table III No vesiculation was observed in any of the examples.

Although good bleaching was observed in Examples 39 and 40, Examples 41 and 42 illustrate the advantages of incorporating the copper(II) α-diimine complex into a developer stop bath, yielding even better results. Moreover, a comparison of Example 44 to Example 43 shows that the addition of a co-catalyst (or secondary bleaching accelerator) to the peroxide bleaching solution increases the effectiveness of the complexes as peroxide catalysts.

Examples 46–48 illustrate that a fixing step prior to the use of the prebath solution containing the copper(II) α-diimine complex, can also enhance bleaching of silver bromoiodide emulsions.

EXAMPLEs 49–51

Use of Copper(II) α-Diimine Complex After Fixing of Motion Picture Film

These examples demonstrate the practice of the present invention wherein fixing is carried out prior to bleaching. Samples of EASTMAN COLOR PRINT™ motion picture film were exposed for 1/250 second using a 0–3 density, 21 step tablet with HA 50 and 1700 filters. The samples were then processed at 36.7° C. using the protocols described below. The prebath used prior to development was a standard borate/sulfate buffer for loosening the antistatic/antihalation layer on the backside of the film support. Approximately 1.51 g/m$^2$ of silver metal was developed in the $D_{max}$ area of each sample. Bleaching was considered complete when the residual silver in $D_{max}$ areas was less than 108 mg/m$^2$, as measured by X-ray fluorescence. The prebath solution used after fixing contained the copper(II) α-diimine complex according to the present invention.

Table IV below lists the reagents and amounts used in the prebath solution for accelerating bleaching. Bleaching was carried out using the Control A solution (0.98 mol/l hydrogen peroxide).

In Example 49, bleaching was complete in 20 seconds with no vesiculation using the following protocol:

| | |
|---|---|
| 10 seconds | Prebath* |
| 3 minutes | Development** |
| 40 seconds | Stop solution(1% v/v $H_2SO_4$) |
| 40 seconds | Water wash |
| 40 seconds | First fixing*** |
| 40 seconds | Water wash |
| 1 minute | Prebath@ |
| 1 minute | Water wash |
| Various times | Bleaching |
| 40 seconds | Water wash |
| 40 seconds | Fixing*** |
| 1 minute | Water wash |
| 10 seconds | PHOTO-FLO ™ rinse |

*The prebath solution (per liter) was an aqueous solution of sodium borate, decahydrate (20 g) and sodium sulfate (100 g) and had a pH of 9.25.
**The developer solution (per liter) was an aqueous solution of aminotris-(methylenephosphonic acid), pentasodium salt (40% w/w) (1 ml), sodium sulfite (4.3 g), sodium bromide (1.7 g), sodium carbonate (17.1 g) and KODAK ™ Color Developing Agent CD2 (2.95 g), and had a pH of 10.53.

-continued

***The fixing solution (per liter) contained a solution (100 ml) of ammonium thiosulfate (56.5%) and ammonium sulfite (4%) and sodium metabisulfite (13 g), and had a pH of 5.
@Contains the copper(II) diimine complex as in Table IV below.

In Example 50, bleaching was complete in seconds with no vesiculation using the same protocol as in Example 49 except that the prebath (after the first fixing step) and subsequent wash times were each 20 seconds instead of 1 minute.

Example 51 was the same as Example 50 except that the first fixing and subsequent wash steps were omitted. Bleaching was complete in 20 seconds with no vesiculation.

Examples 49–51 demonstrate that for the noted motion picture film, excellent bleaching was obtained with or without a fixing step prior to bleaching.

A Control L process was carried out in which the prebath and wash following fixing were omitted. Complete bleaching required 60 seconds using a conventional solution of potassium ferricyanide (30 g/l) and sodium bromide (17 g/l) having a pH of 6.5.

TABLE IV

| Experiment | Copper(II) Level (mmol/l) | α-Diimine Ligand (mmol/l) | Complete Bleaching (seconds) |
|---|---|---|---|
| Example 49 | 2 | Compound 1(2) | 20 |
| Example 50 | 2 | Compound 1(2) | 20 |
| Example 51 | 2 | Compound 1(2) | 20 |
| Control L | None | None | 60 |
| Example 52 | 2 | Compound 1(2) | 15 |
| Example 53 | 2.5 | Compound 1(2.5) | 15 |
| Control M | None | None | 30 |

EXAMPLES 52–53

Processing of Color Photographic Paper

These examples demonstrate the practice of the present invention to process EKTACOLOR EDGE™ photographic color paper. Samples of the paper were exposed for 1/10 second using a 0–3 density, 21 step tablet with HA-50, INC-0.13 and NP-11 filters. The samples were processed at 35° C. using the protocols shown below. Silver metal (approximately 778 mg/m$^2$) was developed in the $D_{max}$ area. Bleaching was considered complete when the residual silver metal in $D_{max}$ areas was less than 54 mg/m$^2$, as measured by X-ray fluorescence.

In Example 52, the paper was processed using the following protocol and a solution identical to the Control A solution, except that it contained 0.65 mol/l of hydrogen peroxide. Table IV above lists the amounts of the complex reagents used in the prebath solution. Bleaching was complete within 15 seconds with no vesiculation.

| | |
|---|---|
| 45 seconds | Development* |
| 30 seconds | Stop solution(1% v/v $H_2SO_4$) |
| 30 seconds | Water wash |
| 1 minute | Prebath*** |
| 1 minute | Water wash |
| Various times | Bleaching |
| 45 seconds | Water wash |
| 45 seconds | Fixing** |
| 1 minute, 30 seconds | Water wash |
| 10 seconds | PHOTO-FLO ™ rinse |

-continued

*The developer was an aqueous solution (per liter) of triethanolamine (12.4 g), PHORWITE™ REU optical brightener (2.3 g), lithium polystyrene sulfonate (30% w/w, 0.3 g), N,N'-diethylhydroxylamine (4.5 g), lithium sulfate (2.7 g), KODAK™ Color Developing Agent CD3 (5 g), potassium chloride (1.6 g), potassium bromide (7 mg) and 1-hydroxyethyl-1,1-diphosphonic acid (60% w.w) (1.2 g), and had a pH of 10.1.
**As in Examples 1–5.
***Contains the copper(II) diimine complex as shown in Table IV.

In Example 53, the paper was processed as described above except the stop solution contained acetic acid (1 mol/l), sodium acetate (0.1 mol/l), copper sulfate, hydrate (2.5 mmol/l) and Compound 1 (2.5 mmol/l) in water. No prebath or subsequent wash was used. Bleaching was complete within 15 seconds with no vesiculation.

A Control M process was carried out using EKTACOLOR™ RA bleaching solution using the protocol above except that the prebath and following wash steps were omitted. Bleaching was complete within 30 seconds.

Examples 52 and 53 illustrate the bleaching rate advantage of this invention over the conventional bleaching process of Control M.

EXAMPLE 54

Use of Copper(II) α-Diimine Complexes with Persulfate Bleaching Solutions

This example demonstrates the practice of this invention using a persulfate bleaching solution. The experiments were carried out using a flow-cell apparatus and samples of developed KODAK GOLD PLUS™ 100 photographic film as described above in Examples 1–5.

In both experiments, the following bleaching solution was used: sodium persulfate (0.1 mol/l), sodium bromide (0.15 mol/l) and sodium acetate (0.04 mol/l) in water. The pH was adjusted to 3.7 with acetic acid (0.26 mol/l).

When developed KODAK GOLD PLUS™ 100 photographic film was bleached with the persulfate bleaching solution, no bleaching occurred after 500 seconds.

However, when the developed film was treated with a prebath comprising copper sulfate, hydrate (2 mmol/l) and Compound 1 (10 mmol/l) for 1 minute, rinsed with water for 1 minute, dried and then bleached with the persulfate solution, a $t_{50}$ of 18 seconds was observed.

The invention has been described in detail with particular reference to preferred embodiments thereof, but it will be understood that variations and modifications can be effected within the spirit and scope of the invention.

We claim:

1. A method for processing a color silver halide photographic element comprising:

treating an imagewise exposed and developed color silver halide photographic element with a peroxide bleaching solution comprising a peroxide bleaching agent, and a complex of copper(II) ion and an α-diimine ligand, said copper(II) ion being present in an amount of at least about 0.0002 mol/l, and said peroxide bleaching solution having a molar ratio of copper(II) ion to said ligand of less than or equal to about 4:1.

2. The method of claim 1 wherein said solution has a molar ratio of copper(II) ion to said ligand of from about 2:1 to about 1:5.

3. The method of claim 1 wherein said copper(II) ion is present in an amount of from about 0.0002 to about 0.05 mol/l.

4. The method of claim 1 wherein said peroxide bleaching solution further comprises a rehalogenating agent.

5. The method of claim 1 wherein said α-diimine is represented by the structure (I):

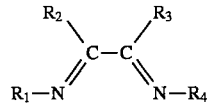

wherein $R_1$, $R_2$, $R_3$ and $R_4$ are independently hydrogen, an alkyl group having 1 to 12 carbon atoms, an aryl group having 6 to 14 carbon atoms in the ring structure, a heterocycle having 5 to 14 carbon, nitrogen, sulfur or oxygen atoms in the ring structure, a cycloalkyl group having 5 to 14 carbon atoms in the ring structure, —OR' or —NR'R", R' and R" are independently hydrogen, an alkyl group having 1 to 12 carbon atoms, an aryl group having 6 to 14 carbon atoms in the ring structure, a heterocycle having 5 to 14 carbon, nitrogen, sulfur or oxygen atoms in the ring structure, or a cycloalkyl group having 5 to 14 carbon atoms in the ring structure, or $R_1$ and $R_2$ together, or $R_3$ and $R_4$ together, independently represent the nitrogen, oxygen, sulfur and carbon atoms necessary to form a 5- to 14-membered N-containing heterocyclic ring structure, or $R_2$ and $R_3$ together represent the carbon atoms necessary to form a 5- to 14-membered carbocyclic ring structure, or the nitrogen, oxygen, sulfur and carbon atoms necessary to form a 5- to 14-membered heterocyclic ring structure.

6. The method of claim 5 wherein each of $R_1$ and $R_2$ together, and each of $R_3$ and $R_4$ together, represent the atoms necessary to form the same 5- to 12-membered N-containing aromatic heterocyclic ring structure.

7. The method of claim 6 wherein each of $R_1$ and $R_2$ together, and each of $R_3$ and $R_4$ together, represent the carbon and nitrogen atoms necessary to form a pyridine, pyrimidine, pyrazine or pyridazine ring.

8. The method of claim 5 wherein said α-diimine is a 2,2'-bipyridine, 2,2'-bipyrimidine, 2,2'-bipyrazine, 3,3'-bipyridazine or 1,10-phenanthroline.

9. The method of claim 1 wherein said complex is represented by the formula $[CuL_n]^aX^y_m$ wherein L is a bi- or tridentate α-diimine ligand, n is 1 to 3, "a" is the charge of the complex, X is a counterion for the complex, y is the charge of the counterion, and m is the absolute value of the ratio of "a" to y.

10. A method for processing a color silver halide photographic element comprising:

A) treating an imagewise exposed and developed color silver halide photographic element with a solution comprising a complex of copper(II) ion and an α-diimine ligand, said copper(II) ion being present in an amount of at least about 0.0002 mol/l, and said solution having a molar ratio of copper(II) ion to said ligand of less than or equal to about 4:1, and B) bleaching said element with a peroxide bleaching solution comprising a peroxide bleaching agent.

11. The method of claim 10 wherein said bleaching solution comprises bromide or chloride as a rehalogenating agent.

12. The method of claim 10 further comprising a fixing step prior to step A.

13. The method of claim 10 wherein said solution used in step A is a development stop solution.

14. The method of claim 10 wherein a second complex of copper(II) ion and an α-diimine ligand is used in step B, said copper(II) being present in said bleaching solution in an amount of at least about 0.0002 mol/l, and said bleaching solution having a molar ratio of copper(II) ion to said ligand of less than or equal to about 4:1, said second complex being the same or different from said complex used in step A.

15. A peroxide bleaching solution comprising:

a peroxide bleaching agent, a complex of copper(II) ion and an α-diimine ligand, said copper((II) ion being present in an amount of at least about 0.0002 mol/l, and said solution having a molar ratio of copper(II) ion to said ligand of less than or equal to 4:1, and a rehalogenating agent.

16. The solution of claim 15 further comprising one or more components selected from the group consisting of:

a defoaming agent, a halogen scavenger, a secondary bleaching accelerator, a calcium chelating agent, a corrosion inhibitor, and an optical whitening agent.

* * * * *